US006755567B2

(12) United States Patent
Watanabe et al.

(10) Patent No.: US 6,755,567 B2
(45) Date of Patent: Jun. 29, 2004

(54) HAND MOTION IRREGULARITY SUPPRESSED TIMEPIECE

(75) Inventors: Mamoru Watanabe, Chiba (JP); Yuichi Shino, Chiba (JP); Tamotsu Ono, Chiba (JP); Kei Hirano, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/339,071

(22) Filed: Jan. 9, 2003

(65) Prior Publication Data

US 2003/0137902 A1 Jul. 24, 2003

(30) Foreign Application Priority Data

Jan. 18, 2002 (JP) ..... 2002-009544

(51) Int. Cl.[7] ..... G04B 5/00; G04B 19/02

(52) U.S. Cl. ..... 368/207; 368/80; 368/147; 368/220; 368/223

(58) Field of Search ..... 368/145, 147, 368/151, 169, 206–207, 80, 220, 223

(56) References Cited

U.S. PATENT DOCUMENTS 3,643,421 A * 2/1972 Herr et al. ..... 368/67
3,678,679 A * 7/1972 Lee et al. ..... 368/262
3,765,164 A * 10/1973 Esselborn ..... 368/190
3,864,904 A * 2/1975 Jung ..... 368/109
4,201,040 A * 5/1980 Nakayama ..... 368/35
5,331,608 A * 7/1994 Umemoto et al. ..... 368/10
5,712,831 A * 1/1998 Ikegami ..... 368/88

* cited by examiner

*Primary Examiner*—David Martin
*Assistant Examiner*—Michael L. Lindinger
(74) *Attorney, Agent, or Firm*—Adams & Wilks

(57) ABSTRACT

To provide a hand motion irregularity suppressed timepiece whose ability has been improved. As to a spring having a flat portion and a bent portion, the flat portion is disposed between a second chronograph wheel and a center wheel, and the bent portion is sandwiched and supported under a pressurized state by a train wheel bridge and a bottom plate. By this, the spring portion prevents a hand motion irregularity of the second chronograph wheel by the fact that the second chronograph wheel is pressure-contacted with the train wheel bridge. Further, by forming a gap between the second chronograph wheel and the center wheel, an accompanying rotation between the second center wheel and the center wheel is prevented.

20 Claims, 3 Drawing Sheets

HAND MOTION IRREGULARITY SUPPRESSED TIMEPIECE

BACKGROUND OF THE INVENTION

The present invention relates to a timepiece with hand motion irregularity suppression and having an indicating hand for indicating current time or elapsed time such as a minute hand or second hand.

Heretofore, in a timepiece such as primarily a chronograph, there has been used a hand motion irregularity suppression structure for suppressing irregular motion of the hand.

FIG. 4 is a front view showing a conventional hand motion irregularity suppressed timepiece, and shows an example of a chronograph. Further, FIG. 5 is a partial plan view of FIG. 4. Incidentally, FIG. 4 and FIG. 5 are views each showing a state after an assembly of parts such as a wheel has been completed.

In FIG. 4 and FIG. 5, a second chronograph wheel 102 and a center wheel 104 are disposed between a wheel train bridge 101 and a bottom plate 106. A shaft 105 is integrally formed in the second chronograph wheel 102, the center wheel 104 is inserted through the shaft 105, and thus the second chronograph wheel 102 and the center wheel 104 are coaxially disposed. The second chronograph wheel 102 is meshed with a second chronograph intermediate wheel 103.

A plate-like spring 401 for suppressing the hand motion irregularity of the second chronograph wheel 102 is disposed between the second chronograph wheel 102 and the center wheel 104.

The spring 401 is formed in a long plate-like form, and in its center portion there is formed a through-hole 402 and in its both end portions there are formed through-holes 404, 406. The through-hole 402 is inserted through the shaft 105, and the through holes 404, 406 are so disposed that they are respectively fitted to convex portions 403, 405 formed in the bottom plate 106.

The spring member 401 is formed such that its center portion is deflected upward (toward the wheel train bridge 101) in FIG. 1 with respect to its both end portions and, after the assembly has been completed, functions such that the center portion of the spring 401 causes the second chronograph wheel 102 to pressure-contact with the wheel train bridge 101 as shown in FIG. 4. By this, the hand motion irregularity of the second chronograph wheel 102 is suppressed.

Further, since a gap, is formed between the second chronograph wheel 102 and the center wheel 104, it becomes possible to prevent the second chronograph wheel 102 from being rotated (so-called accompanying rotation) by a friction when the center wheel 104 is rotated.

However, with the conventional hand motion irregularity suppression structure described above, there is a problem in that the ease of assembling the device is inferior.

FIG. 6 is a view showing an assembling process of the conventional timepiece mentioned above, and the same reference numeral is given to the same portion as FIG. 4 and FIG. 5.

As shown in FIG. 6, since it is necessary for the second chronograph wheel 102 and the second chronograph intermediate wheel 103 to be assembled on the deflected spring 401, unless the spring 401 is pushed toward the bottom plate 106 when assembling the second chronograph wheel 102 and the like, the second chronograph wheel 102 does not mesh with the second chronograph intermediate wheel 103. Accordingly, since the assembly must be performed while meshing the second chronograph wheel 102 with the second chronograph intermediate wheel while pushing the spring 401 toward the bottom plate 106, there is the problem that the assembling ability is inferior.

A subject of the present invention is to provide a hand motion irregularity suppressed timepiece whose assembling ability is improved.

SUMMARY OF THE INVENTION

According to the present invention, there is provided a hand motion irregularity suppressed timepiece in which that a first wheel and a second wheel, which are coaxially disposed, and a third wheel meshing with the first wheel, are disposed between a first support member and a second support member, and an indicating hand is rotated by rotation-driving each of the wheels, and there is further provided a spring disposed between the first and second wheels having a flat portion and a bent portion formed at one end of the flat portion, and the first wheel is pressure-contacted with the first support member existing at a side opposite to the second wheel disposing the flat portion of the spring between the first and second support members. Since the flat portion of the spring is disposed between the first and second wheels and the bent portion is sandwiched and supported under a pressurized state by the first and second support members, the first wheel is pressure-contacted with the first support member existing at a side opposite to the second wheel.

In addition, the spring may form a gap between the first and second wheels.

Further, the other end portion of the spring may be provided with a through-hole through which a shaft for coaxially disposing the first and second wheels is inserted.

Further, the shaft may be integrally formed with the first wheel, and the second wheel is inserted through the shaft.

Further, the first wheel may be a second chronograph wheel.

Further, the second wheel may be a number two wheel.

Further, the third wheel may be a second chronograph intermediate wheel.

DETAILED DESCRIPTION OF THE PREFERRED EMBODIMENTS

Figure 1:
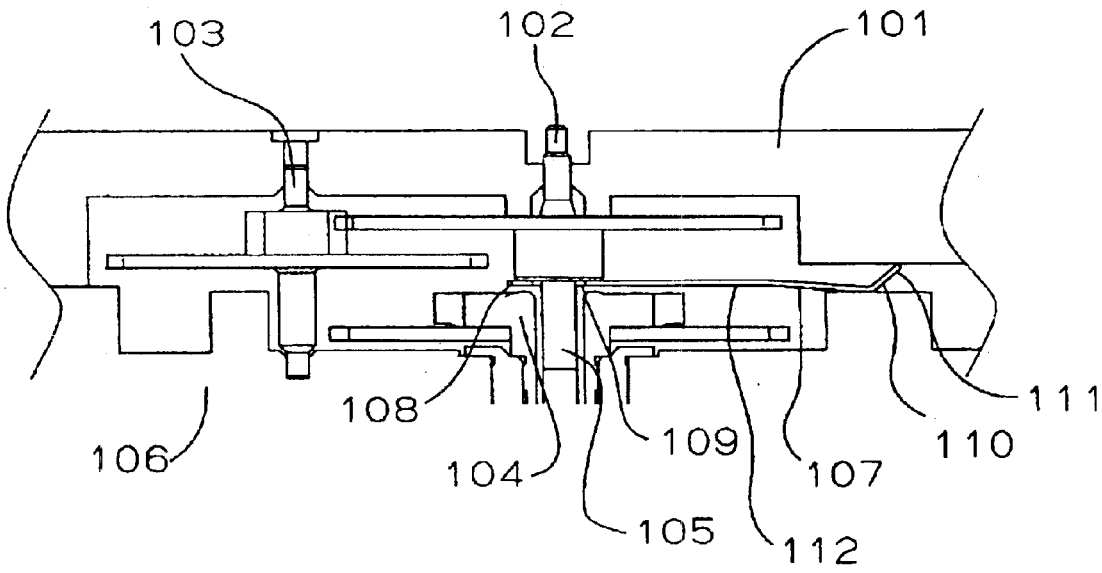
FIG. 1 is a partial front view of a hand motion irregularity suppressed timepiece according to an embodiment of the present invention.
Figure 2:
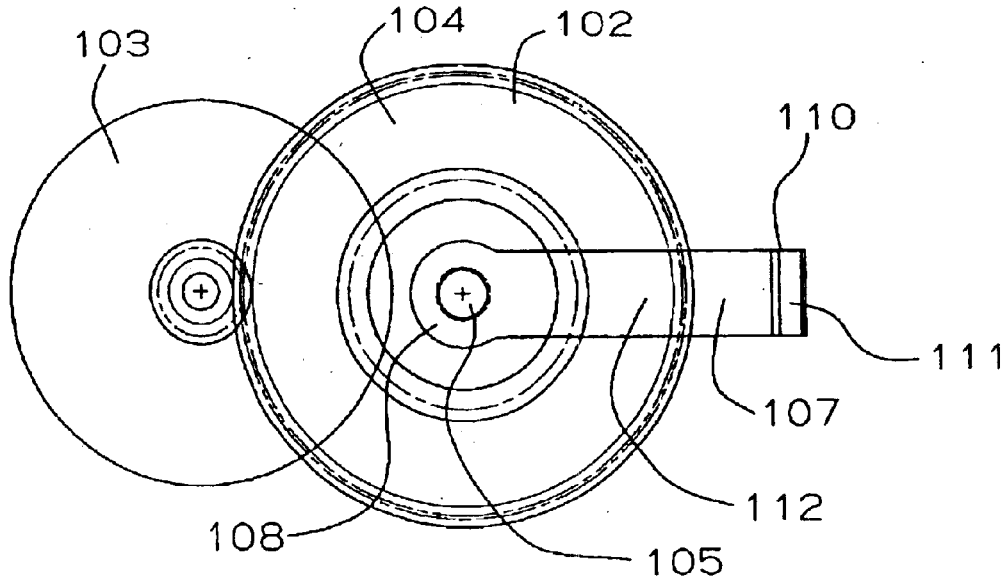
FIG. 2 is a partial plan view of FIG. 1.

FIG. 1 is a partial front view of a hand motion irregularity suppressed timepiece according to an embodiment of the present invention, and shows an example of chronograph. Further, FIG. 2 is a partial plan view of FIG. 1. Incidentally, FIG. 1 and FIG. 2 are views each showing a state after an assembly of parts such as a wheel has been completed.

In FIG. 1 and FIG. 2, the second chronograph wheel 102 constituting a first wheel, the second chronograph intermediate wheel 103 constituting a third wheel and the center wheel 104 constituting a second wheel are disposed between the wheel train bridge 101 constituting a first support member and the bottom plate 106 constituting a second support member. The shaft 105 is integrally formed in the second chronograph wheel 102. The center wheel 104 is inserted through the shaft 105, and thus the second chronograph wheel 102 and the center wheel 104 are coaxially disposed. A gear of the second chronograph wheel 102 is meshed with a pinion of the second chronograph intermediate wheel 103.

A spring 107 for suppressing the hand motion irregularity of the second chronograph wheel 102 is disposed between the second chronograph wheel 102 and the center wheel 104.

The spring 107 has a long, approximately plate-like shape as a whole and is so configured such that its end part is bent. The spring 107 has a flat portion 112 formed flatly and in a long plate-like form and a bent portion 111 provided in one end portion 110 and bent by a predetermined angle with respect to the flat portion 112 (hereafter, the spring 107, is referred to as a cantilever spring).

A through-hole 109 is provided in the other end portion 108 of the flat portion 112. The through-hole 109 is inserted through the shaft 105.

The bent portion 111 is sandwiched and supported by the wheel train bridge 101 and the bottom plate 106 in a pressurized state, and the bent portion 111 is formed so as to bias the other end portion 108 toward the second chronograph wheel 102. By this, the second chronograph wheel 102 is biased toward the wheel train bridge 101 by the spring 107 and held under a state of being pressure-contacted with the wheel train bridge 101, and a gap is formed between the second chronograph wheel 102 and the center wheel 104, so that the second chronograph wheel 102 and the center wheel 104 are held under a spaced state without contacting each other.

Accordingly, the hand motion irregularity of the second chronograph wheel 102 is suppressed. Further, since the gap is formed between the second chronograph wheel 102 and the center wheel 104, it becomes possible to prevent the second chronograph wheel 102 from being rotated (so-called accompanying rotation) by a friction when the center wheel 104 is rotated.

Figure 3:
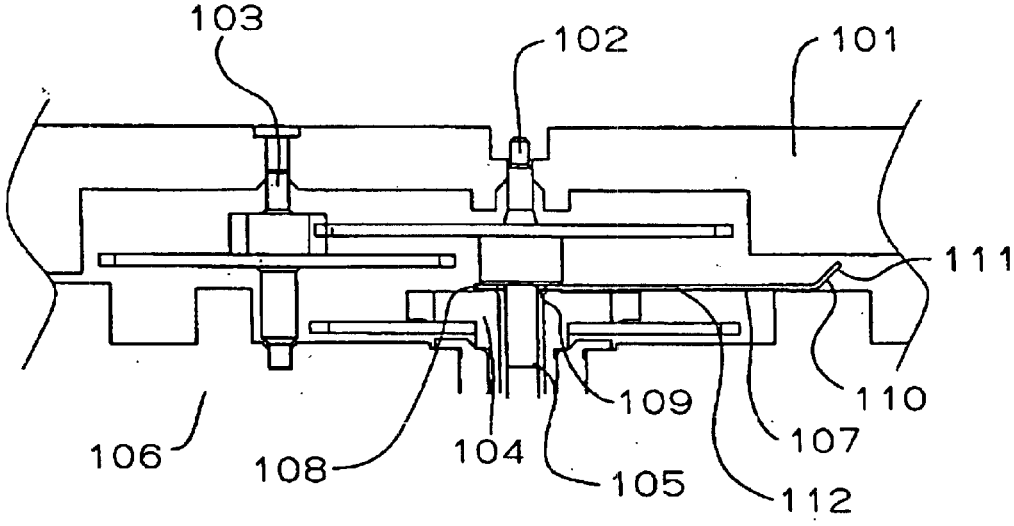
FIG. 3 is a view showing an assembling process of the hand motion irregularity suppressed timepiece according to the embodiment of the present invention.
Figure 4:
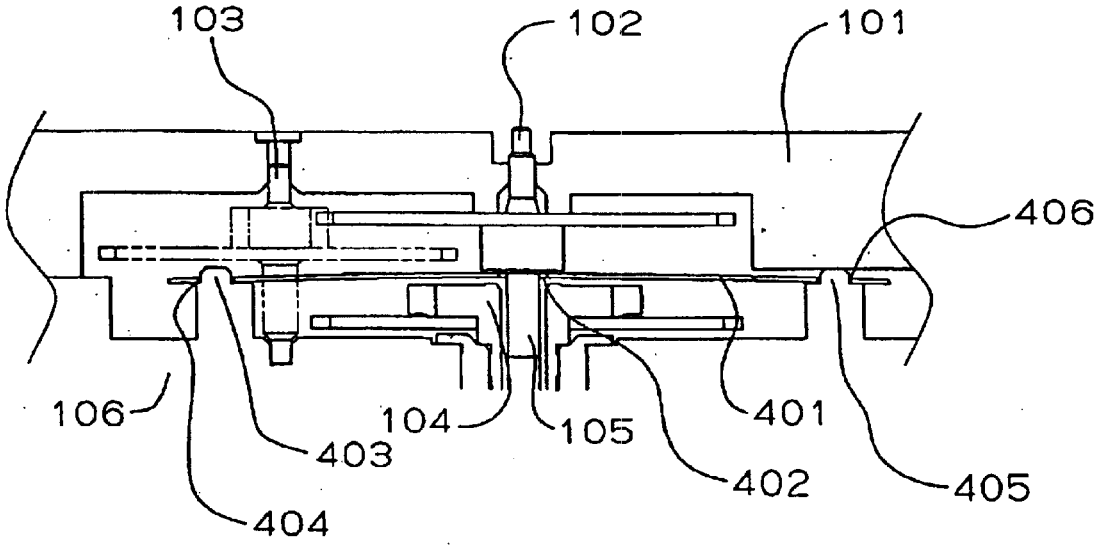
FIG. 4 PRIOR ART
FIG. 4 is a partial front view of a conventional hand motion irregularity suppressed timepiece.
Figure 5:
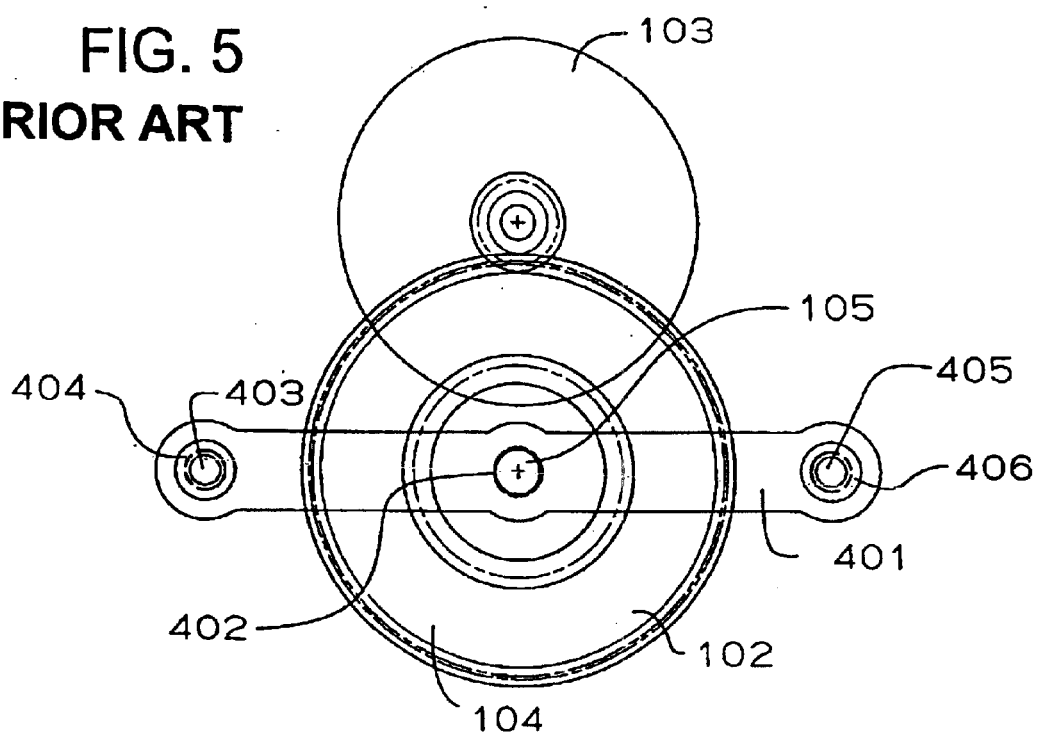
FIG. 5 PRIOR ART
FIG. 5 is a partial plan view of FIG. 4.
Figure 6:
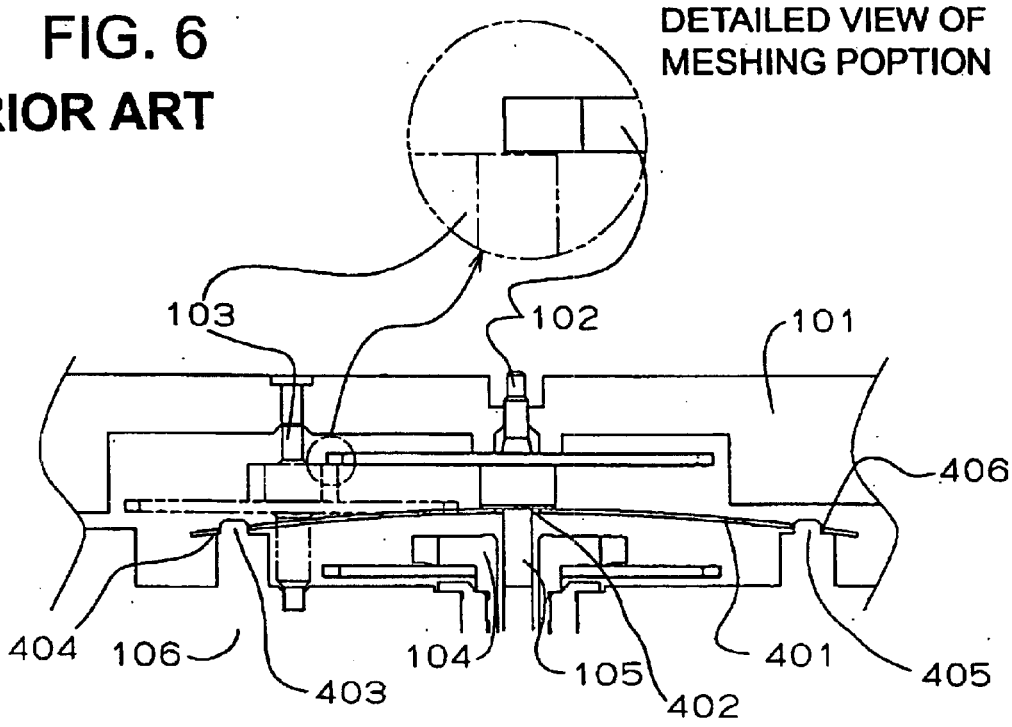
FIG. 6 PRIOR ART
FIG. 6 is a view showing an assembling process of the conventional hand motion irregularity suppressed timepiece.

Next, a method of assembling the hand motion irregularity suppressed timepiece according to the embodiment is described. FIG. 3 is a view showing an assembling process of the hand motion irregularity suppressed timepiece according to the embodiment, and the same reference numeral is given to the same portion as FIG. 1 and FIG. 2.

When assembled, after the spring 107 has been mounted on the center wheel 104, and the second chronograph intermediate wheel 103 is mounted on the bottom plate 106, the second chronograph wheel 102 is then mounted on the spring 107, and thereafter the wheel train bridge 101 is mounted.

Since the second chronograph wheel 102 is mounted on the flat portion 112 of the spring 107, it is unnecessary to push the spring 107 to the bottom plate 106 side in order to align the second chronograph wheel 102 and the second chronograph intermediate wheel 103 to thereby mesh them with each other. Accordingly, it becomes possible to easily align the second chronograph wheel 102 and the second chronograph intermediate wheel 103 to thereby mesh them with each other.

Further, by the fact that the bent portion 111 of the spring 107 is sandwiched and supported by the wheel train bridge 101 and the bottom plate 106 under a pressurized state, the other end portion 108 side of the spring 107 is biased toward the wheel train bridge 101, so that the second chronograph wheel 102 is pressure-contacted with the wheel train bridge 101 by the spring 107 and thus hand motion irregularity is suppressed. Additionally, by the fact that the second chronograph wheel 102 is pressure-contacted with the wheel train bridge 101 by the spring 107, it becomes impossible for the second chronograph wheel 102 to contact with the center wheel 104, so that accompanying rotation between the second chronograph wheel 102 and the center wheel 104 is prevented.

As described above, the hand motion irregularity suppressed timepiece according to the embodiment is characterized in that the timepiece has a second chronograph wheel 102 and a center wheel 104, coaxially arranged therewith, and a second chronograph intermediate wheel 103 meshing engaged with the second chronograph wheel 102, the wheels being disposed between a wheel train bridge 101 and a bottom plate 106 and indicating hand is rotated by rotation-driving each of the wheels 102 to 104, and there is further provided a spring 107 disposed between the second chronograph wheel 102 and the center wheel 104 and having a flat portion 112 and a bent portion 111 formed at one end portion of the flat portion 112, and the second chronograph wheel 102 is pressure-contacted with the train wheel bridge 101 existing at a side opposite to the center wheel 104 by the fact that the flat portion 112 of the spring 107 is disposed between the second chronograph wheel 102 and the center wheel 104 and the bent portion 111 is sandwiched and supported under a pressurized state by the train wheel bridge 101 and the bottom plate 106, so that the assembly is simple and it becomes possible to suppress the hand motion irregularity of the timepiece. Further, it becomes possible to prevent the accompanying rotation between the plural coaxially arranged wheels 102, 104.

According to the present invention, it becomes possible to provide the hand motion irregularity suppressed timepiece whose assembly is easy.

What is claimed is:

1. A timepiece having hand motion irregularity suppressing structure, comprising: first and second coaxially disposed wheels; a third wheel meshingly engaged with the first wheel; one or more indicating hands driven by the wheels; first and second support members for supporting the first, second and third wheels therebetween; and a spring for suppressing irregular motion of the time-indicating hands and having a flat portion interposed between the first and second wheels and a bent portion located at one end of the flat portion, the bent portion being forcibly interposed in a gap defined between the first and second support members to urge the flat portion and the first wheel into contact with the first support member to suppress irregular motion of the time-indicating hands.

2. A timepiece having hand motion irregularity suppressing structure according to claim 1; wherein the flat portion of the spring urges the first wheel away from the second wheel to form a gap between the first and second wheels to prevent the second wheel from coming into contact with the first wheel.

3. A timepiece having hand motion irregularity suppressing structure according to claim 1; wherein a second end of the spring opposite the bent portion has a through-hole extending therethrough, and a shaft on which the first and second wheels are coaxially arranged is inserted in the through-hole.

4. A timepiece having hand motion irregularity suppressing structure according to claim 3; wherein the shaft is integrally formed with the first wheel, and the second wheel is inserted through the shaft.

5. A timepiece having hand motion irregularity suppressing structure according to claim 1; wherein the first wheel is a second chronograph wheel.

6. A timepiece having hand motion irregularity suppressing structure according to claim 1; wherein the third wheel is an intermediate second chronograph wheel.

7. A timepiece having hand motion irregularity suppressing structure according to claim 1; wherein the third wheel is an intermediate second chronograph wheel.

8. A timepiece comprising: a plurality of wheels for driving a time-indicating hand for indicating time; first and second opposing support members for rotatably supporting the plurality of wheels; and a spring having a flat portion interposed between first and second ones of the wheels and a bent portion forcibly interposed between the first and second support members so as to urge the flat portion and the first wheel toward one of the support members and to maintain a gap between the first and second wheels to prevent irregular motion of the time-indicating hand.

9. A timepiece according to claim 8; wherein the first and second wheels are coaxially arranged.

10. A timepiece according to claim 1; wherein the flat portion of the spring has a through-hole extending therethrough, and a shaft on which the first and second wheels are coaxially arranged is inserted through the through-hole.

11. A timepiece according to claim 10; wherein the shaft is integrally formed with the first wheel, and the second wheel is inserted through the shaft.

12. A timepiece according to claim 8; wherein the first wheel is a second chronograph wheel.

13. A timepiece according to claim 12; further comprising an intermediate second chronograph wheel meshingly engaged with the second chronograph wheel.

14. A timepiece according to claim 8; further comprising a third wheel meshingly engaged with the first wheel.

15. A timepiece having hand motion irregularity structure for suppressing movement irregularity of a time-indicating hand, comprising: first and second support plates spaced apart by a gap; a plurality of wheels rotatably supported in the gap for driving a time-indicating hand; first and second members provided in the gap and defining a space therebetween; and a spring having a flat portion interposed between first and second ones of the wheels and a bent portion forcibly interposed in the space between the first and second members to cause the flat portion of the spring to urge the first and second wheels spaced apart from each other to prevent irregularity in movement of the time-indicating hand driven by the wheels.

16. A timepiece having hand movement irregularity suppressing structure according to claim 15; wherein the first and second wheels are coaxially arranged.

17. A timepiece having hand movement irregularity suppressing structure according to claim 15; wherein the first and second support plates respectively comprise a base plate and a wheel train bridge of the timepiece, and the first and second support members are respectively provided on the base plate and the wheel train bridge.

18. A timepiece having hand movement irregularity suppressing structure according to claim 15; wherein the flat portion of the spring has a through-hole extending therethrough, and a shaft on which the first and second wheels are coaxially arranged is inserted in the through hole.

19. A timepiece having hand movement irregularity suppressing structure according to claim 18; wherein the shaft is integrally formed with the first wheel, and the second wheel is inserted through the shaft.

20. A timepiece having hand movement irregularity suppressing structure according to claim 18; wherein the plurality of wheels further comprises a third wheel meshingly engaged with the first wheel.

* * * * *